US006431466B1

(12) United States Patent
Kitajima

(10) Patent No.: US 6,431,466 B1
(45) Date of Patent: Aug. 13, 2002

(54) AIR BRUSH

(75) Inventor: Katsuaki Kitajima, Saku (JP)

(73) Assignee: B. B. Rich Co., Ltd., Nagano-Ken (JP)

( * ) Notice: Subject to any disclaimer, the term of this patent is extended or adjusted under 35 U.S.C. 154(b) by 0 days.

(21) Appl. No.: 09/628,430

(22) Filed: Jul. 28, 2000

(30) Foreign Application Priority Data

Apr. 5, 2000 (JP) ..... 2000-103778

(51) Int. Cl.[7] ..... B06B 7/30

(52) U.S. Cl. ..... 239/346; 239/433; 239/600; 239/353

(58) Field of Search ..... 259/346, 353, 259/371, 345, 415, 417.3, 401, 407, 409, 366, 368, 369, 376, 527, 532, 375, 433

(56) References Cited

U.S. PATENT DOCUMENTS 555,669 A * 3/1896 Wold ..... 239/353
1,703,359 A * 2/1929 Paasche ..... 239/346
2,550,404 A * 4/1951 Chasan et al. ..... 239/346
4,161,289 A * 7/1979 Rebold ..... 239/346
5,927,602 A * 7/1999 Robisch et al. ..... 239/419
6,105,881 A * 8/2000 Kitajima ..... 239/353

* cited by examiner

*Primary Examiner*—Lesley D. Morris
*Assistant Examiner*—Davis Hwu
(74) *Attorney, Agent, or Firm*—Bacon & Thomas, PLLC

(57) ABSTRACT

An air brush to draw fine lines and in particular super-fine lines in a small blow-out area, maintain an ideal proportion of air and paint spray from the nozzle, and draw smoothly without spots, ink scattering or omissions by means of operating button of an operating lever formed with a support piece installed in an operating button of an operating lever. A through rod is vertically inserted through an insertion hole in the support piece. A contact piece is attached at the bottom of the through rod. A locking mechanism is provided to clamp the through rod in any desired position or support the through rod for up and down movement. The air brush is configured so that bottom surface of the contact piece may contact with and separate from the top surface of an air brush main body. By tilting the operating lever and causing the contact piece to slide along in contact with the upper edge of the air brush main body, a balanced amount of paint and air can be blown from the nozzle. The drawing of fine and super-fine lines can therefore be achieved without blotches or ink scattering, etc.

2 Claims, 11 Drawing Sheets

AIR BRUSH

BACKGROUND OF THE INVENTION

1. Field of the Invention

This invention relates to an improved air brush and relates in particular to an air brush maintaining an air blow quantity correctly matching the amount of paint blow from the nozzle by a simple operation when drawing fine and superfine lines.

2. Description of Related Art

An airbrush 100 of the prior art has a long, cylindrical air brush main body 101 with a nozzle 102 installed at the tip (extremity) as shown in FIG. 13 and FIG. 14. A needle 103 is provided to freely advance and retract along the center axis within the air brush main body 101. The air brush 100 is structured so that compressed air is supplied to an air supplying port 104 connected to the center of the air brush main body 101. This compressed air is supplied to an aeration passage 112 within the air brush main body 101 by way of an air valve 105 and is blown out from the nozzle 102. The air valve 105 is also configured to open when the operating lever 105*a* is pressed.

In the air brush 100, a pushing lever 108 for depression is connected by way of a pivot shaft 107 to the bottom of the operating lever 106 fitted into the intermediate section of the upper surface of the air brush main body 101. The pushing lever 108 is inserted into the insertion hole 109 inside the main body 101 so that the pushing lever 108 is thus supported and slides along the axis along with the operating lever 106. The tip (extremity) of the pushing lever 108 contacts the tip of the air valve rod 105*a* of the air valve 105. An operating button 106*a* for placement of the user's finger, is formed on top of the operating lever 106.

A valve rod 105*a* is installed inside the connecting cylinder 110 forming the air supplying port, and the force of a coil spring 111 applies a constant upward force so that the upper end of the valve rod 105*a* is maintained in contact with the tip (extremity) of the pushing lever 108 (FIG. 13, FIG. 14).

When the user depresses the operating lever 106, the valve rod 105*a* is depressed by way of the pushing lever 108, and the air valve 105 opens. The compressed air from the air compressor or compressed air source connected to the connecting cylinder 110 is thus supplied into the main body 101 of the air brush, and is blown out from the nozzle 102 by way of an aeration passage 112.

When the user pulls the depressed operating lever 106 further rearward, tilting on the pivot point of the pivot shaft 107, a needle 103 supportably held in a needle chuck 113 moves backward, and the paint supply from the paint container 112 is atomized into a mist by the blowing of compressed air. An operation of this kind that pulls on the operating lever 106 after depressing is called double-action. The spraying of paint is performed by double-action in most cases.

When drawing a fine line by using the air brush 100 of the above described prior art, the operating lever 106 is pushed down and air is blown from the nozzle 102. Next, this same operating lever 106 is pulled back slightly while still depressed, and a small quantity of paint is supplied to the nozzle 102 and a fine line can be drawn. In other words, the paint is applied by double-action of the operating lever 106.

To write a fine line with good appearance by using the air brush 100, the operating lever 106 (needle 103) is pulled back slightly while keeping this same operating lever 106 just slightly depressed, so that a fine line with good appearance and uniform thickness can be drawn. However, this operation of pulling back just slightly on the operating lever 106 while keeping it slightly depressed is difficult even for a veteran and drawing fine lines of uniform thickness while maintaining this position, in particular for drawing super-fine lines is only possible for an extremely limited number of people.

In other words, in order to draw a fine line, most users press the operating lever 106 all the way to the bottom at a maximum air blow quantity, and pulled on the operating lever 106 just a little to draw a fine line with a small paint quantity. Consequently, spots or scattering such as in flower-shaped patterns occurred at the first air blow (See the graph of FIG. 10 and test pattern of FIG. 11.). The air blow quantity was also large compared to the quantity of paint being supplied, so that when fast-drying paint was used, the tip (extremity) of the nozzle 102 became extremely dry, dry paint adhered to the needle 103, the quality of the drawn line deteriorated and omission (paint cut off) points occurred. In worst cases the nozzle 102 became completely clogged.

The air brush of the prior art therefore emitted different air blow quantities when drawing fine and super-fine lines, requiring the user to possess a plurality of air brushes (having different nozzle diameters).

SUMMARY OF THE INVENTION

In view of the above mentioned problems with the prior art, this invention has the object of providing an air brush capable of drawing fine lines and in particular super-fine lines in a small blow-out area, maintain an ideal proportion of air and paint spray quantities from the nozzle, and draw smoothly without spots, ink scattering or omissions.

In order to resolve the above mentioned problems, this invention is configured with a needle moving forwards and backwards along the center axis of an air brush body of a roughly long and cylindrical shape. The needle opens and closes a nozzle formed at the tip (extremity) of the airbrush. An air blow of compressed air is supplied from this nozzle by way of an air valve inside the air brush body. An operating lever is formed inside the air brush at the upper surface. A pushing lever is freely depressed by pivot shaft formed at the bottom of the operating lever and the pushing lever is freely supported along the operating lever for free up and down movement. The bottom of this pushing lever pushes on the top edge of the valve rod that opens and closes the air valve. The valve rod is push-activated by the operating lever and along with opening the air valve, tilts the operating lever rearwards, and makes the needle linked to the operating lever move backwards along the axis of the air brush body. The air brush is configured to atomize the paint supplied to the nozzle by blowing compressed air. A support piece is formed extending forwards from the operating button on the top of the operating lever. A through rod is vertically inserted in an insertion hole in the support piece. A contact piece is attached extending in parallel with the air brush body facing rearward from the bottom of the through rod. A locking mechanism is provided to clamp the through rod in any desired position or support the through red for up and down movement, and the bottom surface of the contact piece may contact with and separate from the top surface of the air brush main body.

In the means described above, pressing the button of the operating lever, causes the valve rod of the air valve to be depressed by way of the pushing lever, and thus open the air valve, supply compressed air into the inside of the air brush, and blow the compressed air from the nozzle. Also, pulling the operating lever rearwards while still depressed, moves the needle inserted along the axial core of the air brush body rearwards. The nozzle is thus opened and paint supplied and the paint is atomized into a mist by the air blow (in the case of double-action).

When drawing fine lines and especially super-fine lines using the air brush, the through rod lowers in the support piece, in a state with the operating lever aligned with the stationary closed valve position, the contact piece formed in the lower end of the through rod makes light contact with the upper edge of the air brush main body. The through rod is clamped to the support piece formed in the operating button and this state is maintained by utilizing a lock mechanism, and the through rod and the contact piece are held so that no movement or play (looseness) occurs.

When the button of the operating lever is slightly pressed while in this state, the operating lever tilts rearward slightly and is depressed sliding rearwards though only a slight amount. The extended tip (rear end) of the contact piece formed in the bottom of the through-rod at this time slides gradually to the rear to the top surface of the air brush main body. At initial movement of the start button, the pivot point supporting the tilt movement of the operating lever, shifts from the pivot section at the bottom of the operating lever, to the extended tip of the contact piece contacting the upper surface of the air brush, and the operating lever then tilts using the extension tip as the pivot point.

In other words, the range (range for drawing super-fine lines and fine lines) that the extension tip of the contact piece makes contact with the upper surface of the air brush main body and slides rearward, increases in proportion to the amount the operating lever is pulled and the amount the operating lever is depressed (single-action). The range for drawing the fine and super-fine lines therefore be increased or decreased while maintaining a suitable ratio between the quantity of air blown from the nozzle and paint supply. In other words, the initial range of the operating lever movement allows single-action dispensing (blow) of a satisfactory quantity of air matching the supply and characteristics of the paint and fine lines can be drawn smoothly and with uniform thickness.

When the operating lever is further pressed from the range used for drawing fine lines, the extension tip of the contact piece moves away (separates) from the air brush main body upper surface and the pivot point of the operating lever returns to the pivot section of the bottom of that same operating lever. The spraying of lines can then be performed with the same characteristics obtained from a conventional air brush.

In the air brush according to second aspect of the invention, a support piece is installed extending forwards from an operating button formed on top of the operating lever, a screw shaft constituted by a male screw is vertically screwed into a screw hole drilled in the support piece, the bottom edge of the screw shaft is fastened to the center of a contacting knob formed in a circular shape seen from a flat plane, and rotation of the screw shaft causes the lower surface of the same contact piece to supportably contact with and separate from the top surface of an air brush main body, and further, the upper edge of the screw shaft pushes against the top edge of the support piece, and a lock screw comprised of a female screw, engages with the top edge of the screw shaft, to make pressure-contact with and separate from the top surface of the contact piece.

The function of the air brush according to second aspect of the invention is related in the subsequent description (preferred embodiments).

DETAILED DESCRIPTION OF THE PREFERRED EMBODIMENTS

The embodiments of this invention will hereafter be described while referring to the accompanying drawings.

Figure 1:
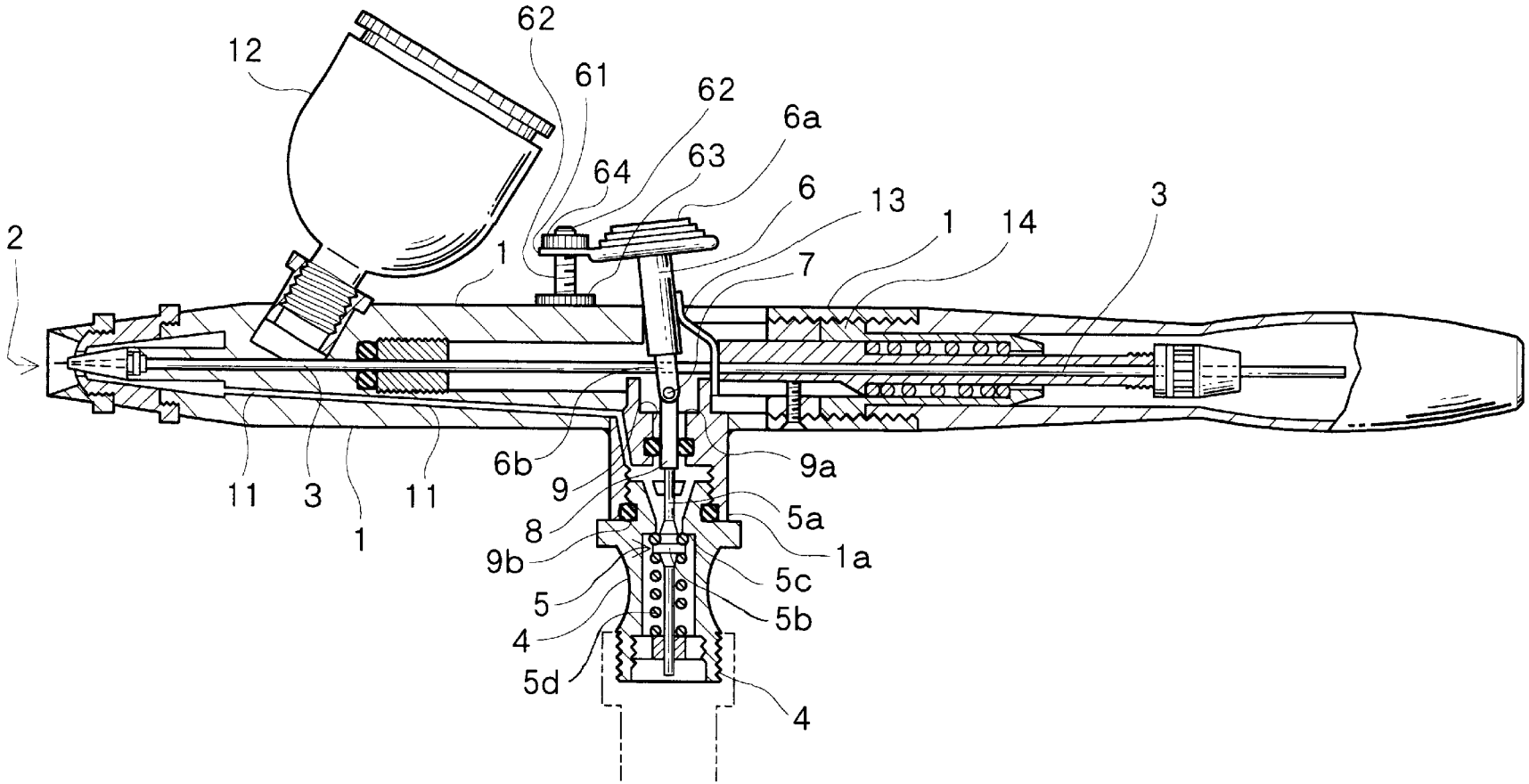
FIG. 1 is vertical cross sectional side view showing the embodiment of the air brush of this invention.

The air brush shown in FIG. 1 along with having a nozzle 2 for blowing out liquid paint and compressed air from the tip (extremity) of an air brush main body 1 formed in a roughly cylindrical shape, further has a needle 3 moving freely forwards and backwards along the center axis of the air brush main body 1 to optionally open and close the nozzle 2. By moving an operating lever 6 to retract the needle 3, liquid paint from a container 12 usually installed in the air brush main body 1 is blown outwards along with compressed air from the nozzle 2 and atomized into a mist.

A connecting cylinder 4 forming the connection inlet for a compressed air hose (not shown in the drawing) is screwed onto the intermediate portion of the air brush main body 1, and an air valve 5 is installed inside the connecting cylinder 4.

The downward pressing action of the valve rod 5*a* integrated with the air valve 5*b*, causes the valve body 5*b* to separate from the valve seat 5*c* and the air valve 5 opens. The opening of the air valve 5 allows compressed air to flow into the air brush main body 1 from the bottom aperture of the connecting cylinder 4 forming the air supply inlet. The compressed air passes through an aeration passage 11 formed inside the air brush main body 1 and is blown outwards from the nozzle 2.

Figure 4:
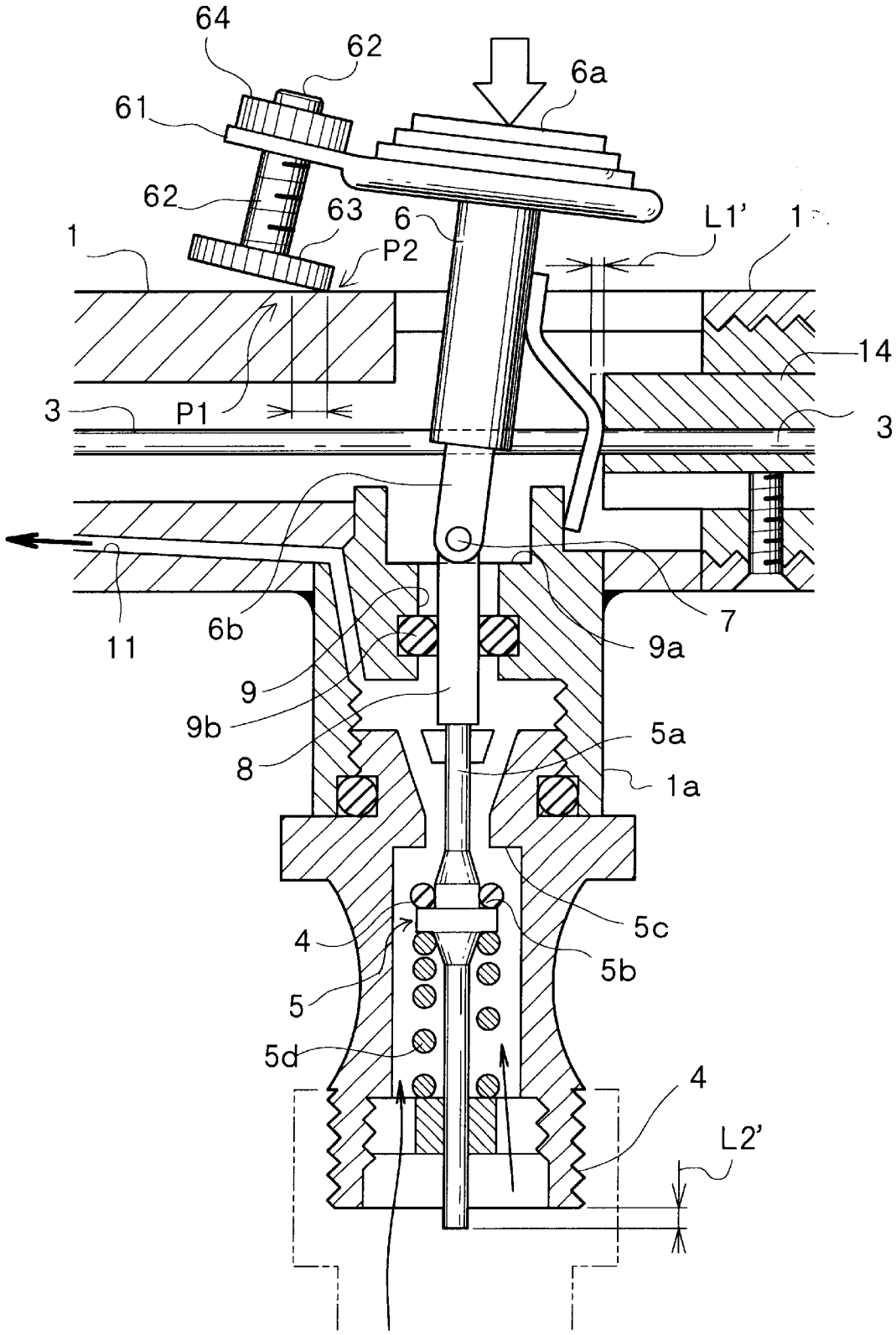
FIG. 4 is a vertical cross sectional side view showing the operating lever section of the air brush with the operating lever even further depressed.

A coil spring 5*d* is installed on the lower side of the valve body 5*b* for the valve rod 5*a* of the air valve 5 to provide constant upward tension or in other words apply a constant force on the valve closing side. The tip (extremity) of the valve rod 5*a* thus maintains an upward protrusion onto the center core in the dual-waist section 1*a* integrated with the lower portion of the center section of the air brush main body 1 (FIG. 4).

An operating lever 6 on the other hand, capable of press operation is inserted into the upper portion of the center section of the air brush main body 1 for an extension of the valve rod 5*a*.

The operating lever 6 provides a base for an operating button 6*a* formed to allow placement of the user's finger and the operating lever 6 also connects to the pushing rod 8 by way of a pivot shaft 7.

Figure 2:
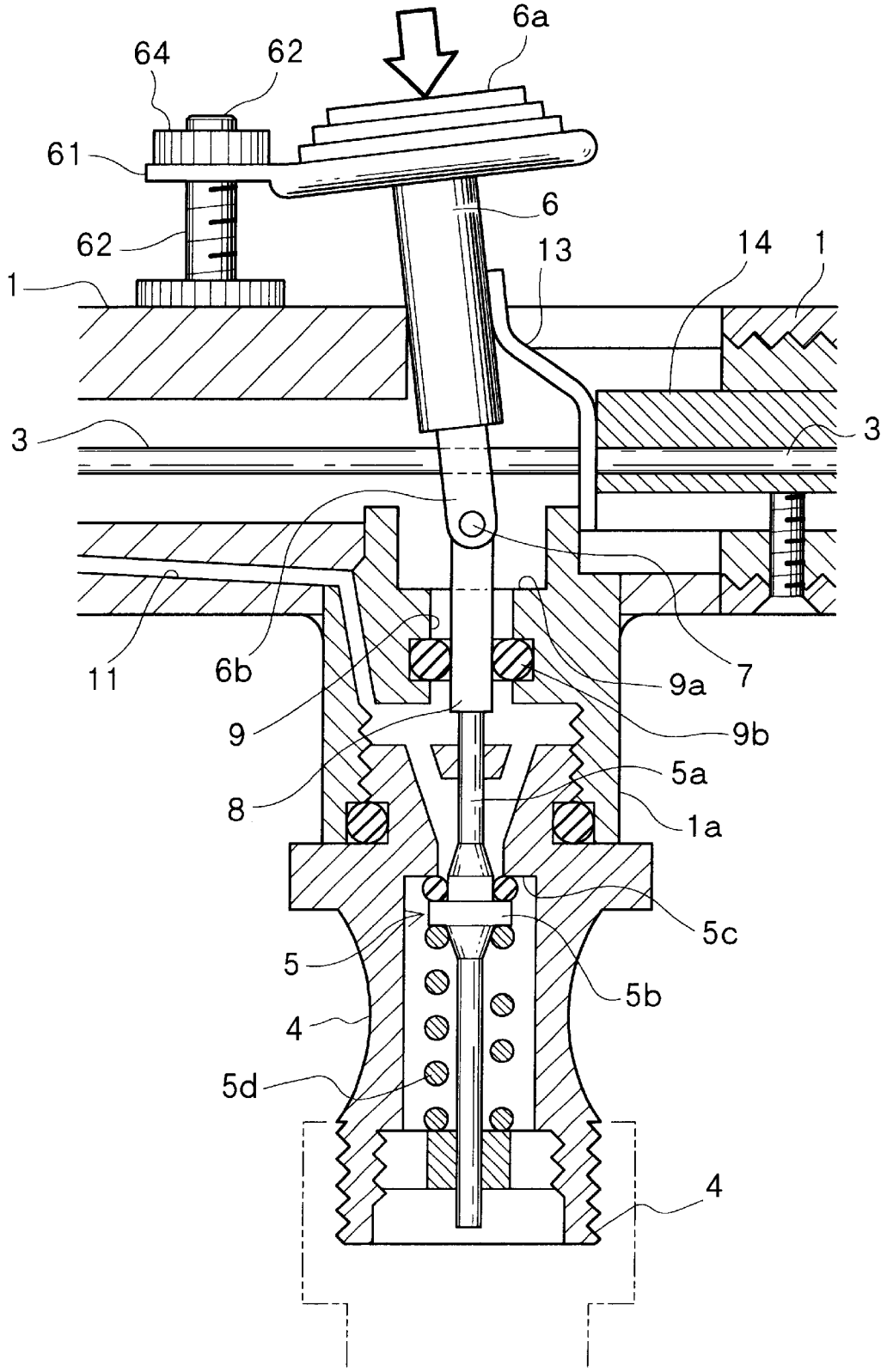
FIG. 2 is vertical cross sectional side view showing the operating lever section of the same air brush.

The lower section 6*b* of the operating lever 6 is formed in a somewhat smaller size as can be seen in FIG. 2 and is branch-formed into dual shapes to allow passage of the needle 3. Then, by inserting a pin as the pivot shaft 7 in the upper portion of the pushing rod 8 between the mutual rounded branch sections of a circular shape as seen from the side, the connection to both members 6 and 8 by way of the pivot shaft 7 allows bending movement.

The pushing rod 8 is a shaft piece inserted for free sliding in an insertion hole 9 drilled in the shaft core of the dual-waist 1*a* of the air brush main body 1. A packing 9*b* is inserted in the insertion hole 9 for sealing. The pushing rod 8 is inserted in the insertion hole 9 from the upper side, and the lower end makes contact with the tip (extremity) of the valve 5*a*. Therefore, the pushing rod 8 and the operating lever 6 are usually supported from below by the valve rod 5*a*. When pressed downward during use, the operating lever 6 moves downward against the resistant force of the coil spring 5*d* and opens the air valve 5.

Pressing the operating lever 6 down, presses the pushing rod 8 into the insertion hole 9, and the tip of the round oval shaped operating lever lower section 6*b* makes contact with the edge 9a formed on the upper side circumference of the insertion hole 9, and the operating lever 6 can be pressed no further (FIG. 4).

So when the user presses the operating button 6*a* of operating lever 6, the pushing rod 8 connecting to the tip of operating lever 6, and the valve rod 5*a* connecting to the tip of the pushing rod 8, are pressed downward, so the valve body 5*b* separates from the valve seat 5*c* and the air valve 5 opens.

When the air valve 5 opens, the compressed air supplied from the compressed air supply hose (not shown in drawing) connected to an air supply port 4, is fed into the aeration passage 11 inside the air brush main body 1, and blown out from the nozzle 2. During normal use, the operating lever 6 remains pressed all the way downwards in a state where a maximum amount of air is being blown outwards.

The now depressed operating lever 6 is next pulled backward to tilt on the pivot point of the pivot shaft 7 as needed. An operating plate 13 tilts, bending into an S shape receiving the inclination of the operating lever 6, and a chuck 14 holding the needle 3 then retracts. Then, when this needle 3 retracts, a specific desired amount of paint is supplied towards the nozzle 2, the paint is atomized into a mist by the blowing of compressed air and blown outwards from the nozzle 2 as a mist. In other words, to draw a fine line, the amount of pull on the operating lever 6 is increased or reduced as needed to adjust the line thickness.

The process of lowering the operating lever 6 and pulling it rearwards, as mentioned before, is referred to as double-action.

An operating button 6*a* is formed on the top edge of the operating lever 6 in the air brush configured as related above. A support piece 61 extending forwards is forms one piece along with the operating button 6. The support piece 61 extends forward from the frontal periphery edge of the circular operating button 6*a*, and is attached in parallel with the top surface of the air brush main body 1 as seen from the side (FIG. 1 and FIG. 2). The air brush of this embodiment is set to maintain a slightly forward inclination during normal operation so that the support piece 61 is made to tilt slightly upward from the periphery of the operating button 6*a*. The support piece 61 has a structure roughly parallel to the upper surface of the air brush main body 1 as seen from the side.

A screw hole 61*a* is drilled in the approximate center of the support piece 61, and a screw shaft 62 is threaded perpendicularly to be held in the screw hole 61*a*. The bottom of the screw shaft 62 is fastened to the center of a contact knob 63 formed in a round shape, and this contact knob 63 is supported to be parallel to the upper surface of the air brush main body 1 as seen from the side.

Gripping and turning the contact piece or the contact knob 63, rotate the screw shaft 62, and due to the threaded interaction of this screw shaft 62 and screw hole 61*a*, the contact knob 63 makes contact with the upper surface of the air brush main body 1, and moves upward. However, with the contact knob 63 in contact with the top surface of the air brush main body 1, the top edge of the screw shaft 62 in the screw hole 61 a of support piece 61, protrudes from the top edge of this same support piece 61.

A lock screw 64 with a round shape is threadably engaged with the top edge of the screw shaft 62 protruding from the upper surface of the support piece 61. The lock screw 64 makes contact with the upper edge of the support piece 61 in a tightened state. The screw shaft 62 is thus attached to the support piece 61, and the bottom edge of the contact knob 63 is held in contact with the upper edge of the air brush main body 1. When the tightened lock screw 64 is loosened, the screw shaft 62 can then rotate, and the height of the contact knob 63 can be adjusted by rotating it, and by re-tightening the lock screw 64, the contact knob 63 can be maintained at a desired position.

The operation when drawing fine lines and super-fine lines using the air brush configured as described above, is now explained.

The lock screw 64 is first of all loosened, and with the air valve 5 closed, a check is made that the operating button 6*a* is in a stationary position. From this state, the contact knob 63 is rotated to the left and the contact knob 63 adjusted to make light contact with the upper surface of the air brush main body 1. The loosened lock screw 64 is next rotated to the right, and tightened to make press-contact on the upper surface of the support piece 61. The settings for drawing fine lines and super-fine lines are now complete (FIG. 2).

Once the above setting is performed, the user attempts to press the operating button 6*a* just slightly. The operating lever 6 which is tilted slightly forward, is tilted back (rearwards) to become vertically upright (FIG. 3), and the contact knob 63 in contact with the parallel upper surface of the air brush main body 1, tilts backwards. In this state, the rear edge of the bottom of the contact piece 63, contacts the upper surface of the air brush main body 1. This contact section is called contact point P from hereon.

In this state, the valve body 5*b* of air valve 5 is depressed as far as L2', a minimum of air passes through this air valve 5, and is blown out from the nozzle 2. At the same time, the needle 3 retracts from P0 to P1, just equal to L1', and a minute amount of paint is supplied toward nozzle 2 that matches the amount of air blow. As a result, no spots or scattering in flower shaped patterns occur, and drawing of a smooth, super-fine line starts (range P1 of FIG. 12) (air blow range n1–P0 through P1 of FIG. 9).

In such a case, by pressing the operating button 6*a*, the pivot point affecting the tilt of the operating lever 6 shifts from the pivot shaft 7 at the bottom of the same operating lever 6*a*, to contact point P at the bottom rear edge of the contact knob 63. The contact point P forming the tilt pivot point moves rearward an amount proportional to the amount of tilt of the operating lever 6, while maintaining contact with the upper surface of the air brush main body 1 (FIG. 4). In the interval until the bottom edge of the operating lever lower section 6*b* makes contact with the edge 9a of the upper side of insertion hole 9, the operating lever 6 retracts the needle 3 from the contact points P1 to P2, just by the distance Li", and at the same time pushes the valve body 5*a* downward by L2". In this interval, the amount the valve body 5*a* is pressed down (air blow quantity) and the distance the needle 3 is retracted (amount of paint supplied) are increased while maintaining a mutual balance. An ideal ratio maintained and paint can be smoothly sprayed for drawing in a range from fine lines to intermediate lines (Range of n1–P1 to P2 in FIG. 9, FIG. 12).

Figure 5:
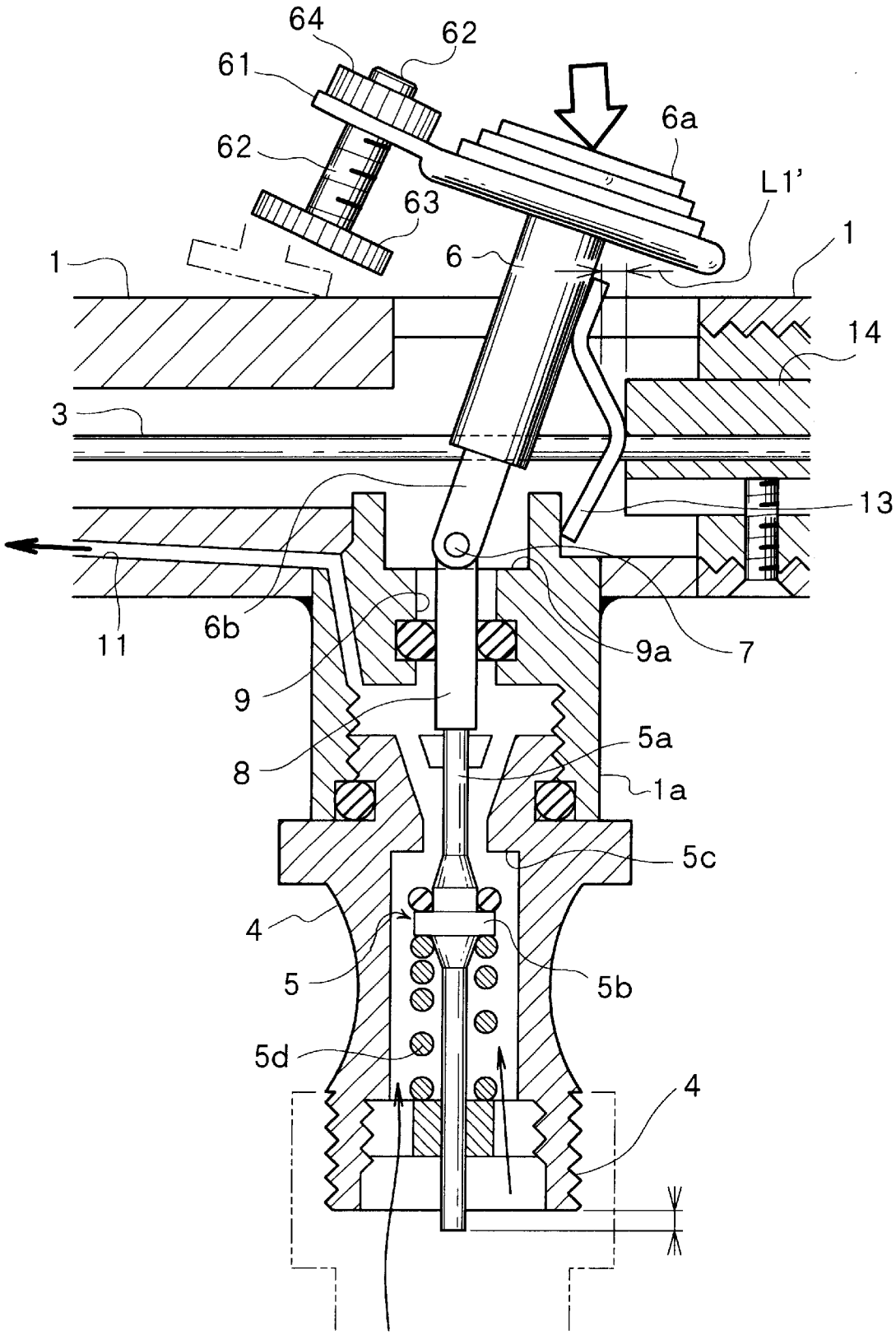
FIG. 5 is a vertical cross sectional view showing the operating lever section of the air brush with the operating lever placed in a maximum tilt position.

The air valve 5 incidentally, is fully open in the state shown in FIG. 4, and the amount of air blown from the nozzle 2 is already at the maximum. When the operating lever 6 is tilted back from this state, the rear edge of the contact knob 63 separates from the top surface of the air brush main body 1, and tilts rearward using the pivot shaft 7 as the pivot point, without pressing the operating lever 6 down (FIG. 5). In other words, after the state shown in FIG. 4, with the air blow maintained at a maximum, the needle 3 retracts up to the nozzle 2 fully open position (position for maximum paint supply). The above mentioned setting is equivalent to the n1 characteristic on the graph shown in FIG. 9, while the state shown in FIG. 5 is equivalent to the state after (P2) on n1 of FIG. 9.

Figure 6:
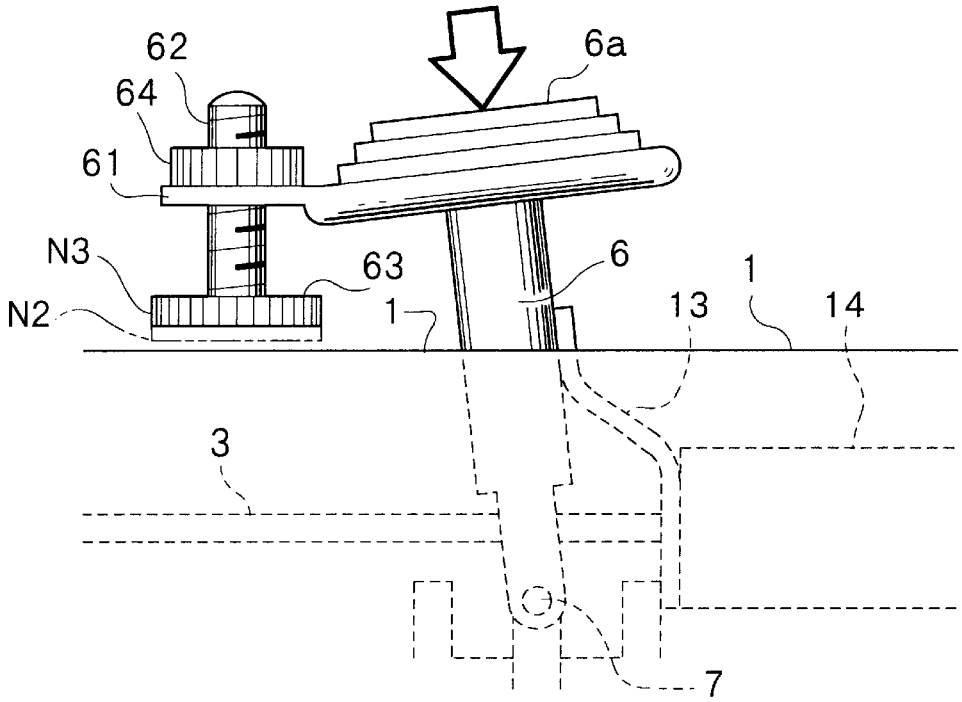
FIG. 6 is a side view showing the contact knob setting height and the screw shaft installed in the support piece formed in the push button of the operating lever.
Figure 9:
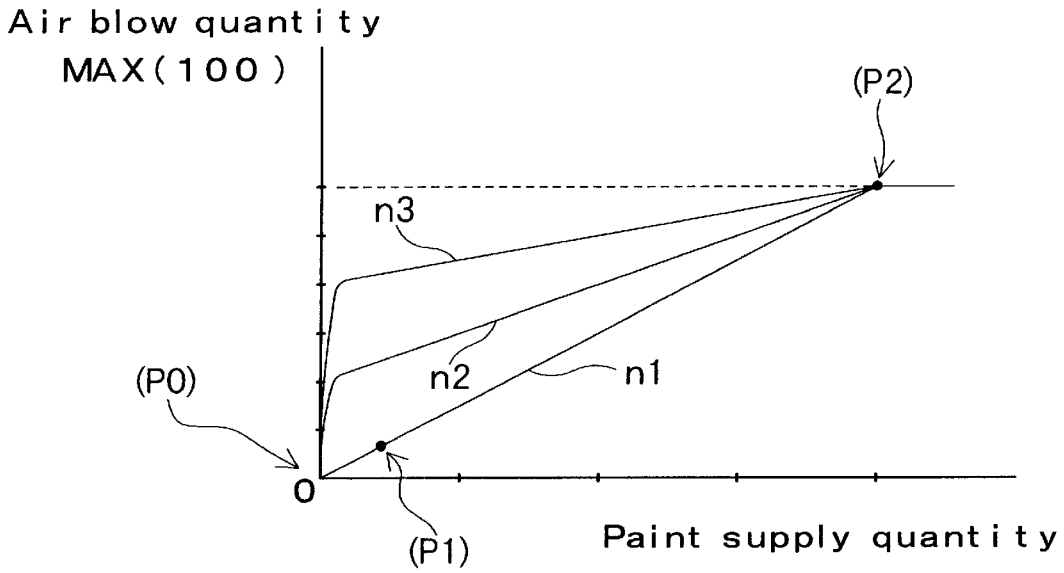
FIG. 9 is a graph showing changes in the quantity of air blow and the quantity of paint supply accompanying the setting of the contact knob.
Figure 10:
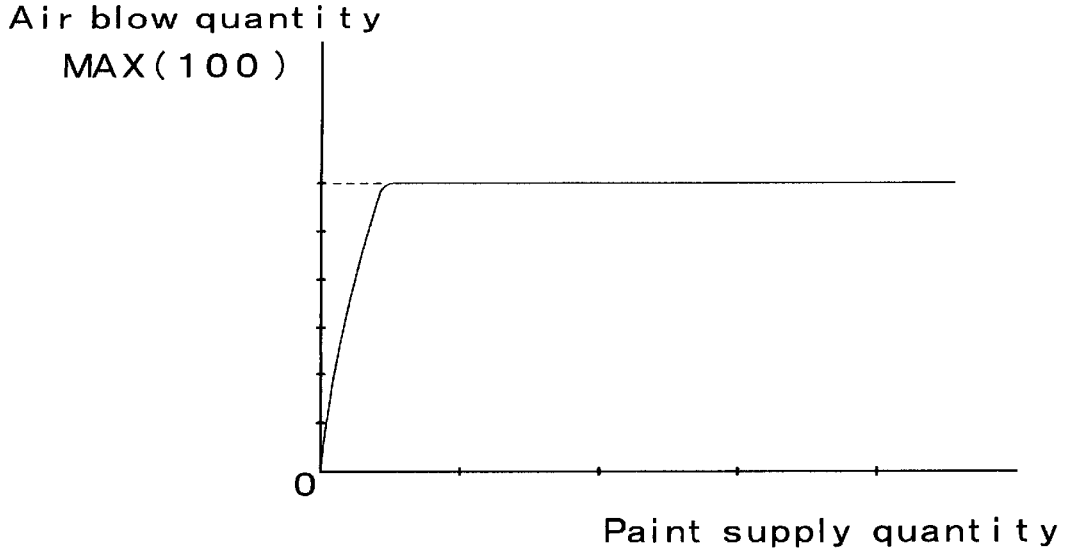
FIG. 10. is a graph showing changes in the quantity of air blow and the quantity of paint supply in the air brush of the conventional art.

The above setting was for drawing super-fine through fine lines, but as shown in FIG. 6, in a state (FIG. 6—N2) with the contact knob 63 fixed at a position slightly above the upper edge of air brush main body 1 or at a higher setting (FIG. 6—N3), the amount of air blow in the initial stage becomes successively larger in steps, as shown by n2 and n3 in the graph in FIG. 9. As a result, the air valve 5 fully opens and the amount of air blow blown from the nozzle 2 gradually increases until a state of maximum air blow is reached. Even at the n2, n3 settings shown in the graph of FIG. 9, the amount the valve 5*a* is depressed (air blow quantity) and the distance the needle 3 is retracted (amount of paint supplied) are increased while maintaining a mutual balance, and a satisfactory paint spray can be maintained in a range from fine lines to intermediate lines.

Figure 3:
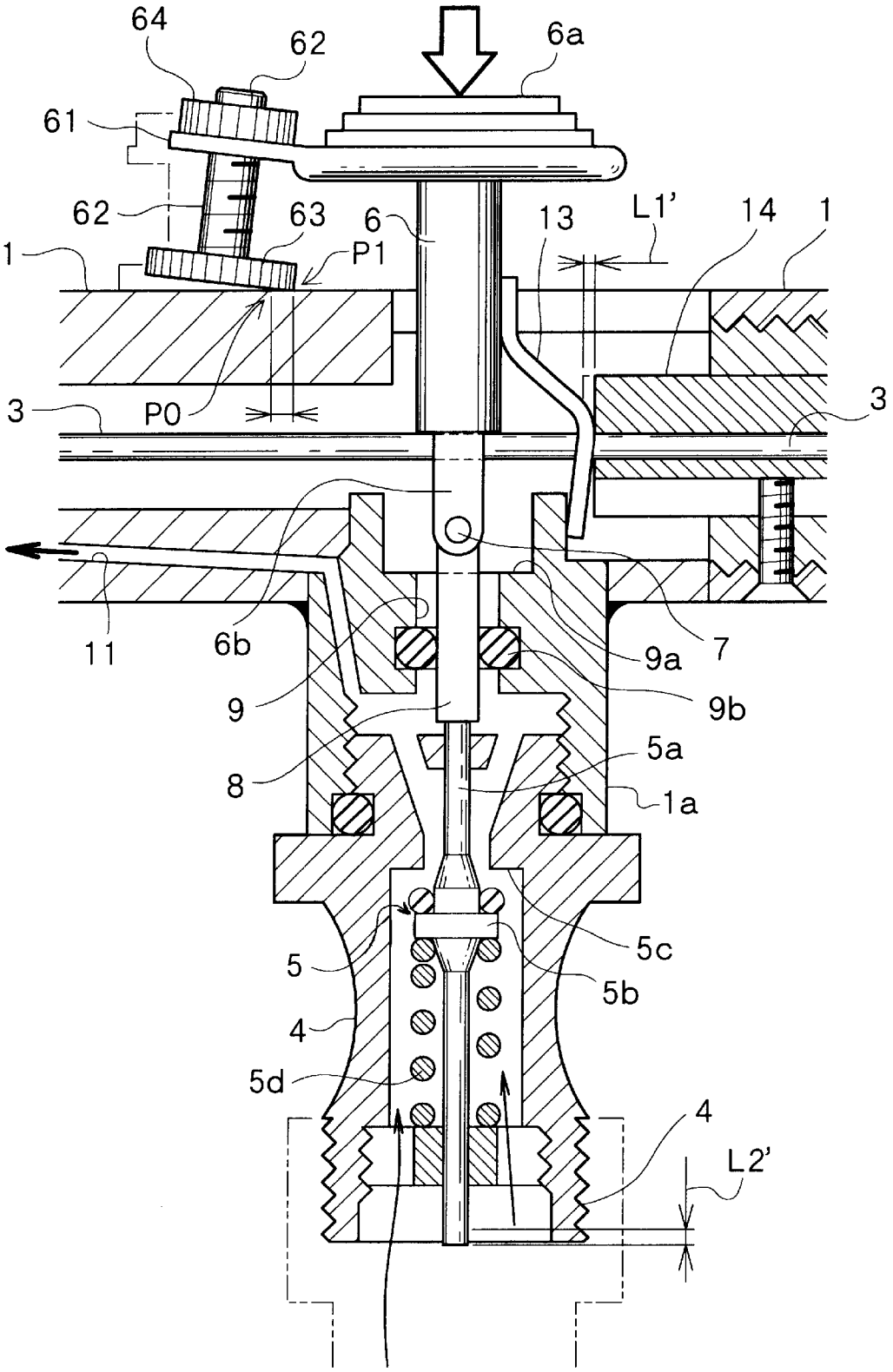
FIG. 3 is a vertical cross sectional side view showing the operating lever section of the air brush while the operating lever is slightly depressed.

Particularly in the range for drawing fine lines and super-fine lines with the air brush described above, or in other words in the sliding range from initial movement of the operating lever 6 to the rear end of the contact knob 63 making contact with the upper edge of air brush main body 1, and more specifically in the range (range of P0 to P2) shown in FIG. 2 through FIG. 4, the operating lever 6 naturally tilts just by pressing on the operating button 6*a*. In other words, using single-action, the air brush is capable of maintaining a balance in the air blow spray quantity and the paint supply quantity to drawn in a range from fine lines to super-fine lines. Therefore, by making the settings for the contact knob 63, even users not accustomed to the air brush, can smoothly draw fine and super-fine lines without breaks or omissions in the lines drawn.

Figure 7:
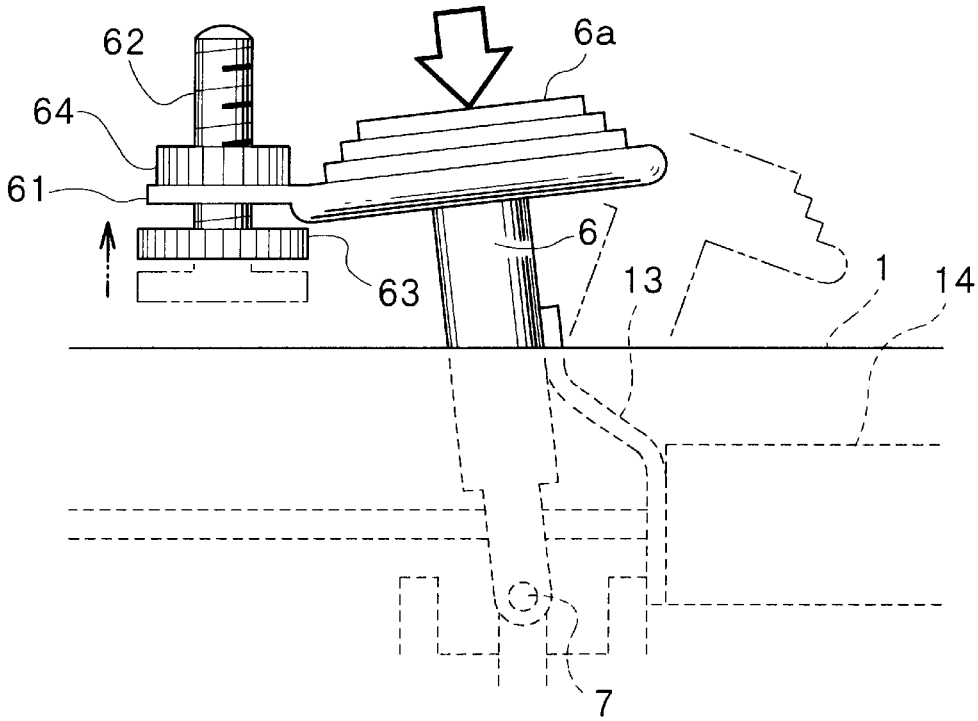
FIG. 7 is a side view showing the operating lever section of the air brush with the contact knob moved to the vicinity of the support piece.

In the air brush of this invention, the contact knob 63 can be tightened in a raised position in the vicinity of the support piece 61 by the lock screw 64, so that the contact knob 63 does not make contact with the air brush main body 1, and can therefore be used in the same way as a conventional air brush (FIG. 7).

The air brush of this invention described in the above embodiment, has a structure to regulate the tilt of the operating lever. This structure is comprised of a screw shaft 62 for installation support of the support piece 61, a contact knob 63, and a lock screw 64. The lock screw 64 makes contact with the upper surface of the support piece 61 so that the screw shaft 62 and the contact knob 63 can be locked at the desired position.

However, the lock mechanism is not limited to the structure described in this invention, and any existing structure for up and down movement of a through rod in a support piece may be utilized if the lower side of the contact piece formed at the lower end of that same support piece can come in contact with and separate from the upper surface of air brush main body 1, and if support can be obtained at the desired position.

Figure 8:
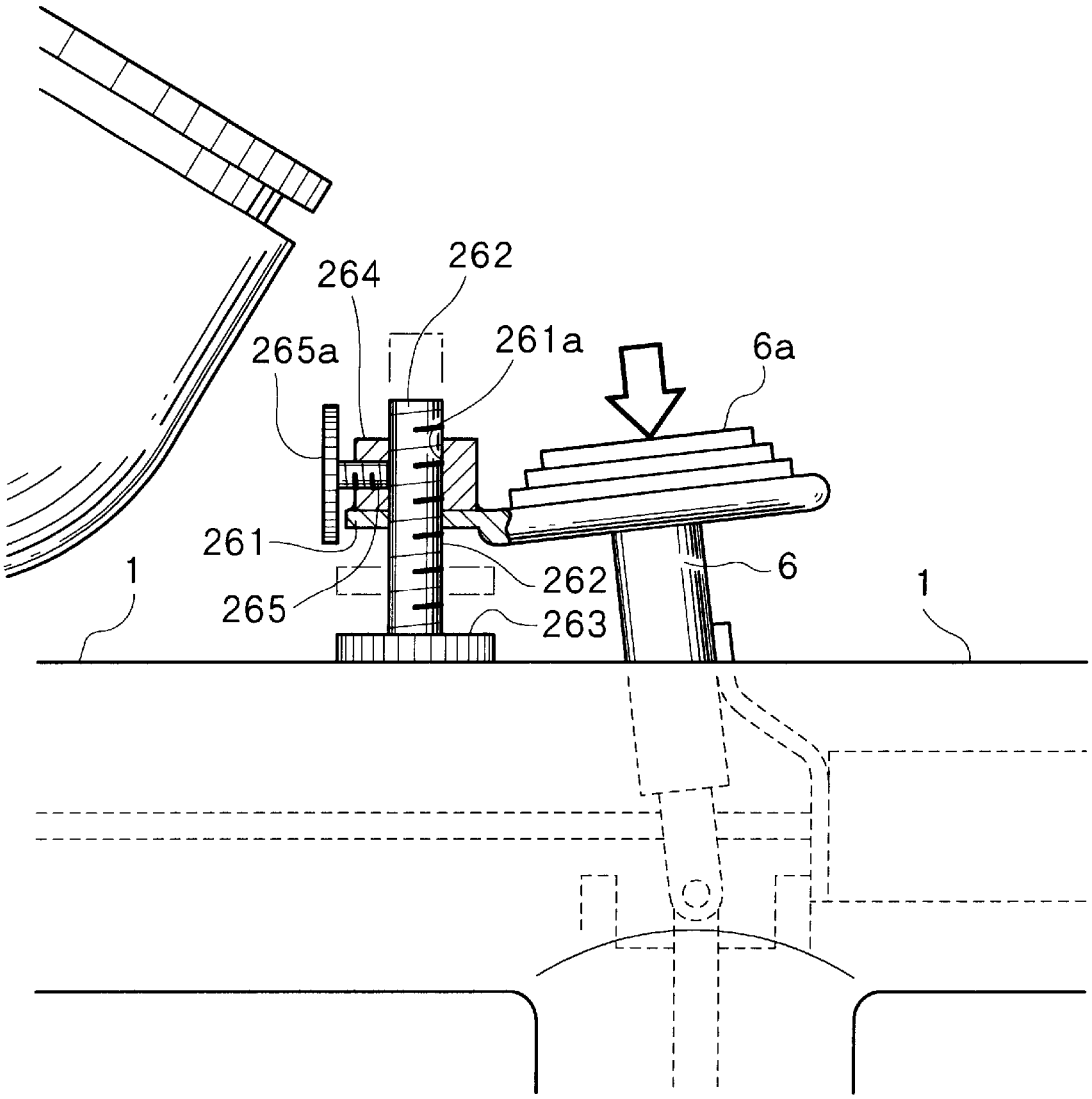
FIG. 8 is a side view of the operating lever section of the air brush showing a portion of the screw shaft and contact knob support structure of another embodiment.

In the embodiment as shown in FIG. 8, a support piece 261 is formed extending forwards from the periphery of the front side of the operating button 6*a*, and a stopper 264 formed integrated with the top surface of that support piece 261, and a screw hole 261*a* is formed through the center section of the stopper 264 and the support piece 261. A through rod 262 formed from a male screw, screwably engages with the screw hole 261*a*, and the bottom end of the through rod 262 is fixed at the center of the contact piece or the contact knob 263. The top end of the through rod 262 however, protrudes from the upper surface of the stopper 264. By gripping and rotating the contact knob 263 the through rod 262 moves upward and downward by threadable engagement with the screw hole 261*a*.

A machine screw 265 with knob 265*a* for threadable engagement is located at the outer circumference of the stopper 264. Tightening this machine screw 265, clamps the through rod 262 in the hole 261*a* at a desired position, in a structure allowing the contact knob 263 to be maintained at the desired height.

In the above embodiment, the through rod 262 machined to form a screw, engaged screwably with the hole 261*a* forming a female screw to allow up and down movement and holding. However, a through rod not machined to have screw threads may also be inserted a suitable amount into the hole and the through rod guided along the hole for up and down movement. In such cases, after the bottom of the through rod has been moved to the desired height with the contact knob, the machine screw 265*a* can be tightened to clamp the through rod (not shown in drawing).

Figure 11:
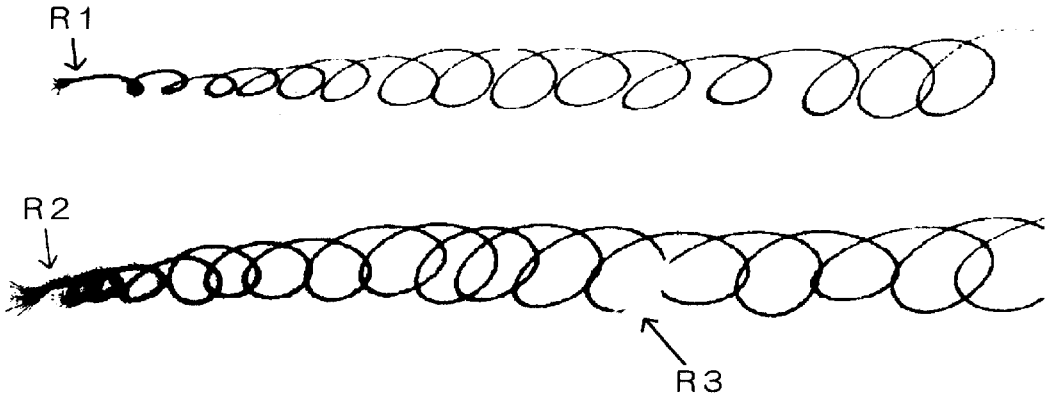
FIG. 11 is a drawing showing fine lines drawn by using an air brush of the conventional art.
Figure 12:
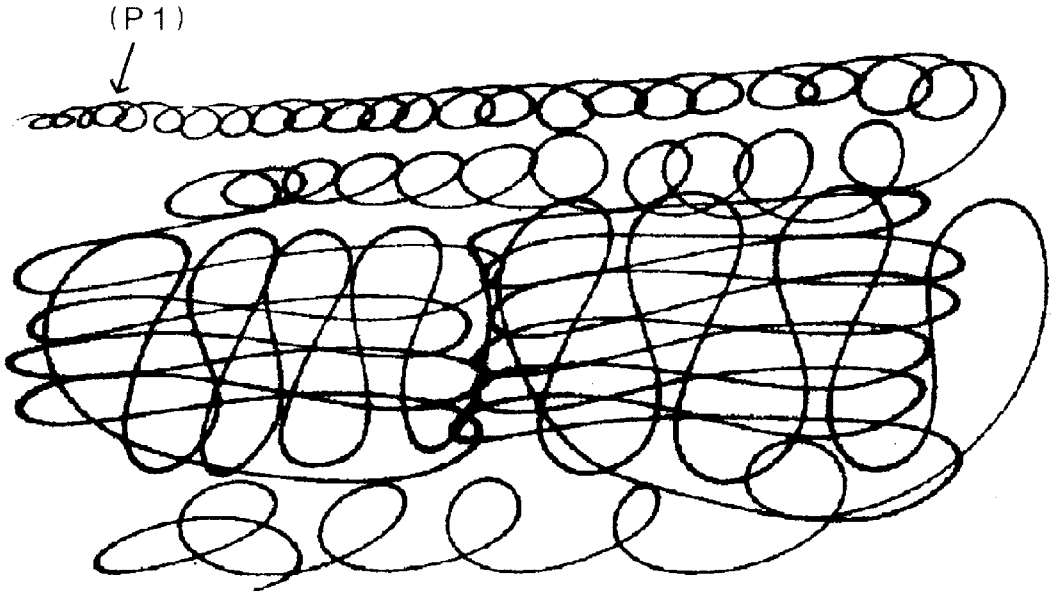
FIG. 12 is a drawing showing fine lines drawn by using an air brush of the embodiment of the invention.
Figure 13:
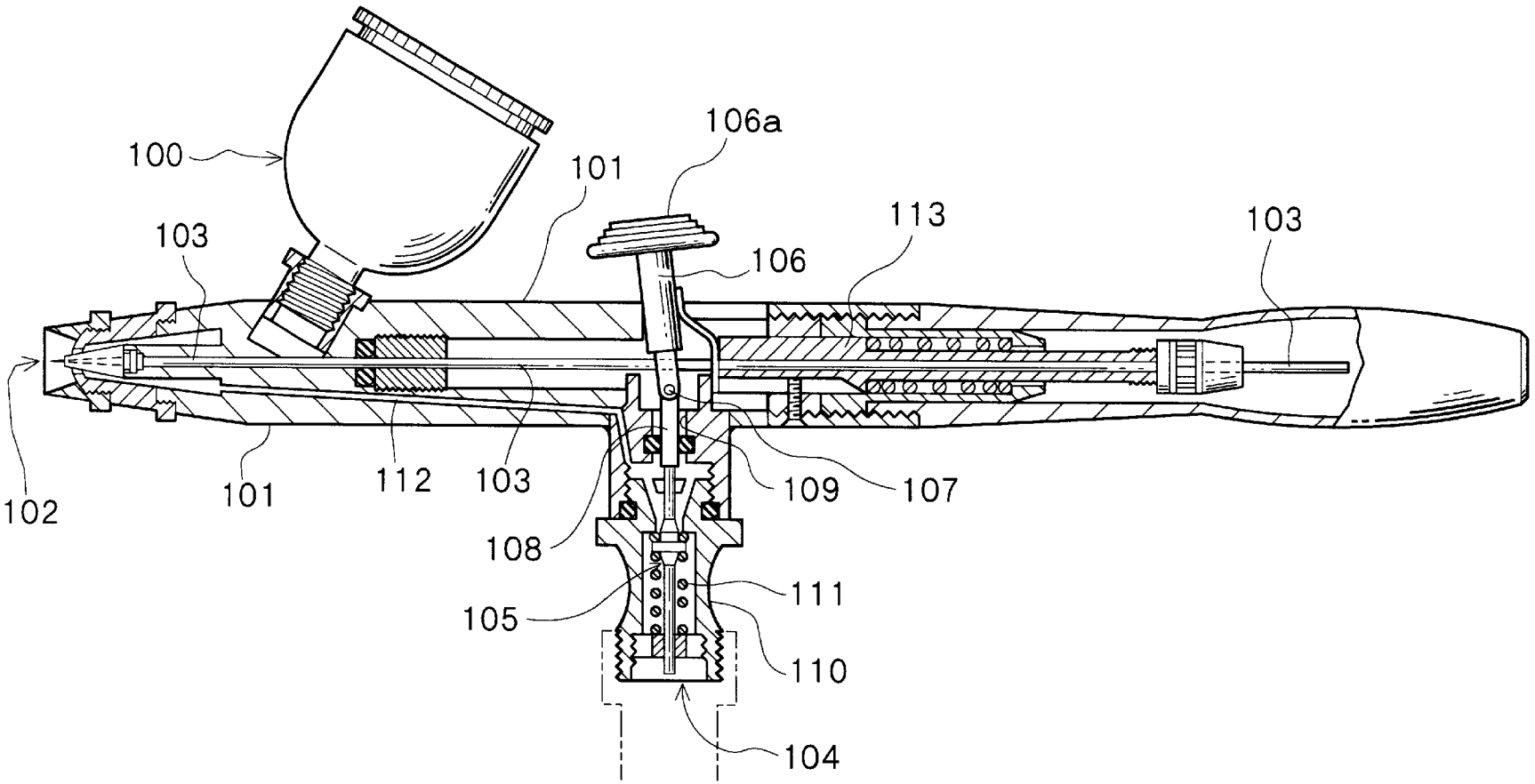
FIG. 13 PRIOR ART
FIG. 13 is a vertical side view showing an air brush of the conventional art.
Figure 14:
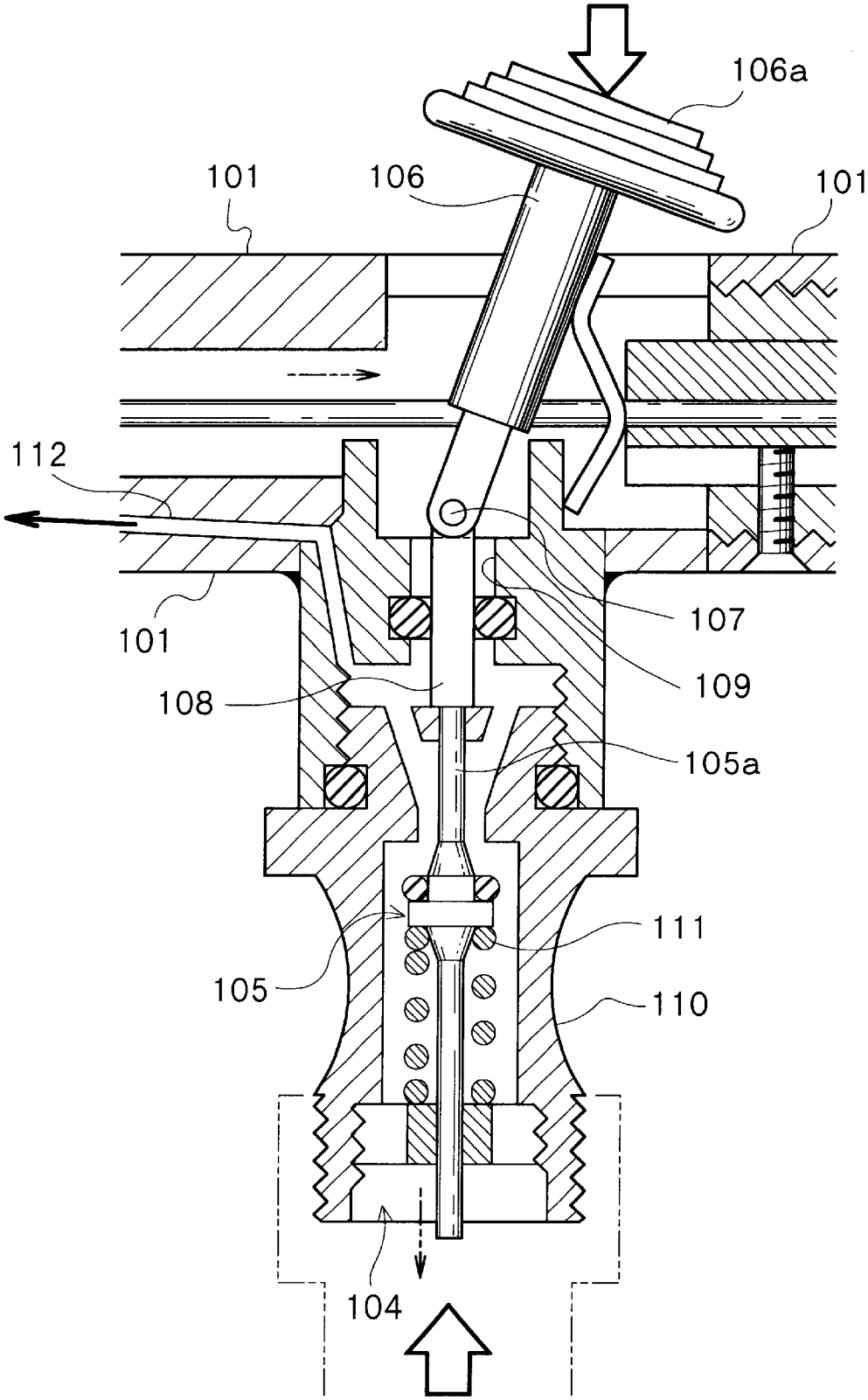
FIG.14 PRIOR ART
FIG. 14 is a vertical side view showing the operating lever section of the same air brush of the conventional art.

FIG. 11 and FIG. 12 shown reproductions made under the same conditions, of line patterns drawn with an air brush of the conventional art, and line patterns drawn with the air brush of the embodiment of this invention. The images may appear somewhat more rough than the actual drawing since these images were reproduced by utilizing a scanner, however the effect of the invention can easily be seen.

In contrast to the line drawn with an air brush of the conventional art in which spot R1, splotch pattern scattering R2, and cutoffs (omissions) R3 in the drawn line occur, at the initial nozzle blow, in the line drawn with the air brush of this invention, an extremely clear line is drawn in particular in the super-fine range or in other words in the first section (P1) of nozzle blow. There are also no cutoffs (omissions) in the line even during continuous drawing of complex shapes, thus confirming that continuous fine lines of uniform thickness can be smoothly drawn.

Thus, when using an air brush of this invention as described above, the lower end of a contact piece installed at the bottom edge of the through rod is appropriately adjusted to make light contact with the upper surface of the air brush main body, and a lock mechanism operated to hold the through rod and the contact piece in this state. Then, by starting to press the operating button, the operating lever tilts and the pivot point supporting the tilt or inclination of the operating lever, shifts from the pivot support section, to the extension tip (extremity) of the contact piece making contact with the upper surface of the air brush main body. The section where the extension tip (extremity) contacts the air brush main body upper surface becomes the pivot point for tilting of the operating lever.

The amount that the operating lever is pulled and the amount the operating lever is pressed, therefore increase and decrease simultaneously and in proportion to each other, in the range that the extension tip of the contact piece makes sliding contact with the upper surface of the air brush main body and in particular at the start of nozzle blow for super-fine lines and also in the fine line range. The amount of air blown from the nozzle and the amount of paint supplied can in this way be increased or decreased as desired, while maintaining an optimal rate.

An optimal air quantity setting can consequently be made that matches the quantity, quality and viscosity of the supplied paint, and mistakes such as spots (or blotches), ink scattering patterns that tend to occur during the start of nozzle blow can thus be prevented and anyone can easily draw clear lines with a smooth, soft touch.

Also, when drawing fine lines and particularly when drawing super-fine lines, by making the contact piece contact the air brush main body, and setting the air blow from the nozzle to a minimum amount, sharp lines of uniform thickness can be continuously drawn with cutoffs (omissions) in the drawn line.

Further, pressing slightly on the operating button of the operating lever is linked to a very slight pulling action (pulling action of needle) in the range for drawing fine lines from the initial nozzle air blow, or in other words, in the range that the extension tip (extremity) of the contact piece makes contact with the upper surface of the air brush main body, so that the air brush can also be operated satisfactorily while having a single-action function.

In the above described use of the operating lever, the contact piece moves to a position separate from the upper surface of the air brush main body, and in a state with the extension tip (extremity) of the contact piece separate from the air brush main body, a paint spray the same as a conventional air brush can be obtained.

Still further, in a state with the contact piece moved sufficiently upwards, the contact piece ceases to make contact with the air brush main body so that the air brush of this invention can be used the same as a conventional air brush.

In the air brush according to second aspect of the invention, a support piece is installed extending forwards from an operating button formed on top of the operating lever, rand a screw shaft consisting of a male screw is screwed vertically into a screw hole drilled in the support piece, and by securing the contact knob at the bottom of the screw shaft and turning the contact knob to rotate the screw shaft, the lower surface of that same contact piece is caused to supportably come in contact with and to separate from the top surface of the air brush main body. The screw shaft upper edge pushes up against the top edge of the support piece, and a clamping lock screw engages with the protruding edge, to cause pressure-contact with or separation from the top surface of the support piece.

Therefore, when using the air brush, adjusting by gripping and turning the contact knob for the screw shaft lower end, makes the lower end of the contact knob make light contact with the upper surface of the air brush main body. Then, tightening the lock screw screwed on the top end of the screw shaft, applies pressure-contact on the upper surface of the support piece so that the contact knob can easily be held at the desired position made with the adjustment.

Further, when the operating button is first pressed to tilt the operating lever, the pivot point for supporting the tilting or inclination of the operating lever, shifts from the pivot support section to the rear edge of the lower side of the lock screw contacting the upper surface of the air brush main body. The contact point of this rear edge and upper surface of the air brush main body becomes the pivot point for tilting or inclination of the operating lever.

In the range that the rear edge of the lock screw makes sliding contact in this way with the air brush main body or in other words, at the start of nozzle blow for super-fine lines and further for fine lines, the amount that the operating lever is pulled and the amount the operating lever is pressed, therefore increase and decrease simultaneously and in proportion to each other. Therefore the amount of air blown from the nozzle and the amount of paint supplied can in this way be increased or decreased as desired, while maintaining an optimal rate.

The air brush of this invention of the above configuration can therefore deliver the same effects as the air brush according to first aspect of the invention. In other words, mistakes such as spots (or blotches), ink scattering patterns that tend to occur during the start of nozzle blow can thus be prevented and a satisfactory operation can be obtained that is the same as when the single action function is provided.

Still further in this invention, a contact knob formed on the bottom of the screw shaft, the top end of the screw shaft protrudes from the top end of the support piece, and the top end threadably engages with a lock screw that is a female screw, this screw shaft is capable of making press-contact with and separating from the upper surface of the support piece. Therefore, a function can be obtained with a simple structure, to simultaneously and proportionately increase and decrease the amount that the operating lever is pulled and the amount the operating lever is pressed. Also when regulating the amount of air blown and the amount of paint supplied, gripping and turning the round contact knob to rotate the screw shaft, allows varying the height of the contact knob and by then tightening the lock screw afterwards, the contact knob can-be reliably secured at the setting position. These settings, adjustments and tightening can further all be accomplished in a simple operation.

Yet further in this invention, in a state with the contact piece rotatably moved sufficiently upwards, the contact piece ceases to make contact with the air brush main body so that the air brush of this invention can be used the same as a conventional air brush.

Having described specific examples of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. An air brush comprising:

a needle movable forwards and backwards along a center axis of an air brush body, the air brush body comprises a cylindrical shape and is adapted to open and close a nozzle formed at one extremity of said air brush body, an operating lever extends inside said air brush body at an upper surface thereof and a pushing rod is depressiable by a lower section formed at a bottom of said operating lever and said pushing rod is freely supported for free up and down movement along with said operating lever, and a bottom of said pushing rod pushes against a top edge of a valve rod, the valve rod opens and closes an air valve positioned below the valve rod, said valve rod is push-activated when said operating lever is pressed to open the air valve and tilt said operating level rearwards from the lower section and actuates said needle linked to said operating lever to move backwards along the axis of the air brush body, said air brush is configured to atomize paint supplied to said nozzle by blowing out compressed air thereof, wherein a support piece is formed extending forwards from an operating button adjacent said operating lever, and a through rod is vertically inserted in an opening in said support piece, a contact piece is attached to the through rod and is detachably positioned parallel with said air brush body and opposingly facing the bottom of said through rod, a lock mechanism is provided on the air brush main body and adapted to clamp said through rod at a desired position to support said through rod for up and down movement, and the bottom surface of said contact piece may contact with and separate from the top surface of said air brush main body.

2. An air brush comprising:

a needle movable forwards and backwards along a center axis of an air brush body, the air brush comprises a cylindrical shape and is adapted to pen and close a nozzle formed at one extremity of said air brush body, an operating lever extends inside said air brush body at an upper surface thereof and a pushing rod is depressable by a lower section formed at a bottom of said operating lever and said pushing rod is freely supported for free up and down movement along with said operating lever, and a bottom of said pushing rod pushes against a top edge of a valve rod, the valve rod opens and closes an air valve positioned below the valve rod, said valve rod is push-activated by when said operating lever is pressed to open the air valve and tilt operating lever rearwards from the lower section and actuate said needle linked to said operating lever to move backwards along the axis of the air brush body, said air brush is configured to atomize paint supplied to the nozzle by blowing out compressed air out thereof, a support piece is installed extending forwards from an operating button formed on top of said operating lever, a screw shaft comprised by a male screw is installed to vertically screw into a screw hole drilled in the support piece, a bottom edge of said screw shaft is fastened to a center of a contact piece formed in a planar circular shape, when said screw shaft is rotated, the lower surface of said contact piece supportably makes contact with and separates from a top surface of an air brush main body, an upper edge of said screw shaft pushes against a top edge of the support piece, and a lock screw comprising a female screw engages with the top edge of said screw shaft to make pressure-contact with and separate from a top surface of said contact piece.

* * * * *